United States Patent [19]

Böttcher et al.

[11] 4,059,946

[45] Nov. 29, 1977

[54] METHOD AND APPARATUS FOR START-SPINNING A THREAD ON OPEN-END SPINNING UNITS

[75] Inventors: Dieter Böttcher, Bad Uberkingen; Heinz Schulz, Donzdorf; Fritz Stahlecker, Bad Uberkingen, all of Germany

[73] Assignees: Fritz Stahlecker; Hans Stahlecker, both of Germany

[21] Appl. No.: 637,050

[22] Filed: Dec. 2, 1975

[30] Foreign Application Priority Data

Dec. 7, 1974 Germany ..... 2458042

[51] Int. Cl.[2] ..... D01H 15/00

[52] U.S. Cl. ..... 57/34 R; 57/58.89; 57/156

[58] Field of Search ..... 57/34 R, 58.89–58.95, 57/78, 80, 83, 156

[56] References Cited

U.S. PATENT DOCUMENTS

| | | | |
|---|---|---|---|
| 3,791,128 | 2/1974 | Landwehrkamp et al. | 57/58.89 X |
| 3,810,352 | 5/1974 | Miyazaki et al. | 57/34 R |
| 3,854,274 | 12/1974 | Bartling | 57/58.95 X |
| 3,879,926 | 3/1975 | Bartling et al. | 57/58.95 |
| 3,939,638 | 2/1976 | Bruckert et al. | 57/156 |
| 3,945,183 | 3/1976 | Landwehrkamp et al. | 57/34 R |
| 3,950,926 | 4/1976 | Stahlecker | 57/34 R |

*Primary Examiner*—Donald Watkins
*Attorney, Agent, or Firm*—Craig & Antonelli

[57] ABSTRACT

In start-spinning a thread, which has to be performed after a condition in which the entire machine has been stopped or after a thread break, the individual working conditions have to be maintained as precisely as possible in order to keep the start-spinning points produced at the same spinning point and at different spinning points as uniform as possible and in order to ensure that they are of sufficient strength. An important criterion in this connection is the size and thickness of the ring of fibers located in the spinning rotor, on which the end of the thread is placed after it has been returned and from which the end of the thread is then drawn off again. This ring of fibers significantly influences the appearance and quality of the start-spinning point of the thread. In order to provide a situation in which it makes no difference whether start-spinning is performed after a brief standstill period or after an extended stand-still period, the silver feed of the spinning unit is switched on briefly prior to the actual start-spinning operation, while the rotor is still stopped. This ensures that the fiber tuft, which extends into the area of the opening means, is the same prior to every start-spinning operation, irrespective of the period of time during which the respective spinning point was stopped.

27 Claims, 8 Drawing Figures

Fig. 4
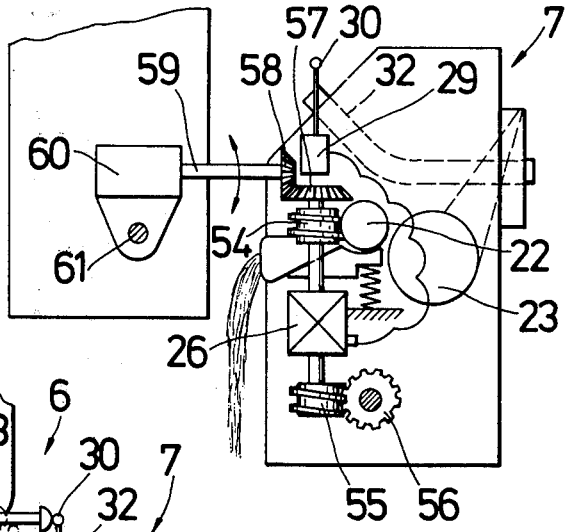
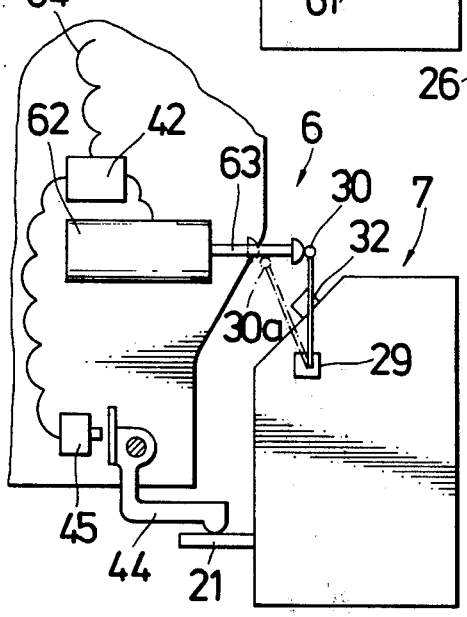
Fig. 5
Fig. 6
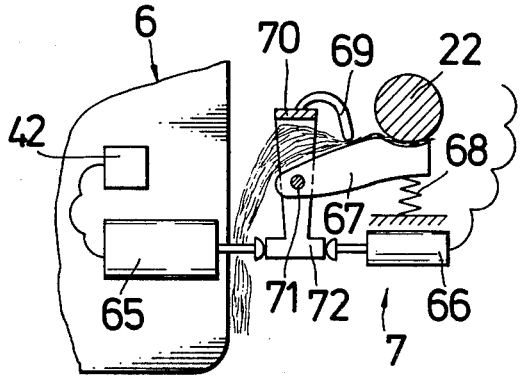

METHOD AND APPARATUS FOR START-SPINNING A THREAD ON OPEN-END SPINNING UNITS

The present invention relates to a method for start-spinning a thread on open-end spinning units.

On open-end spinning units, it is the usual practice to interrupt the sliver feed in the event of a thread break and to let the following opener roller continue to run. If the spinning rotor is also braked, the fibers reaching the spinning rotor are sucked away and removed. A similar procedure is also followed when the spinning machine is switched off: First the sliver feed is switched off and then the spinning rotor is stopped, while the opener roller continues to run for a while thereafter. The purpose of this is to ensure that a certain quantity of fibers are continued in the spinning rotor for the subsequent start-spinning operation. It is known practice to interrupt the sliver feed by opening a clutch arranged in front of a supply roller (German Disclosed Patent Application No. 2,238,610), or by trapping the sliver before it enters the supply roller (German Published Patent Application No. 1,957,014), or by swivelling the supply roller with the inlet hopper away from the opener roller (German Disclosed Patent Application No. 2,134,342). In all cases, after interruption of the feed a fiber tuft offered to the opener roller or the supply roller is combed and drawn out to a greater or lesser extent.

In most cases, the sliver feed is started a given period of time before the start-spinning operation by eliminating the aforementioned feed interruption. It is also known practice (German Disclosed Patent Application No. 2,118,775) to equip a travelling start-spinning unit with an auxiliary drive which acts upon the means for feeding the sliver of the corresponding spinning unit during the start-spinning operation and takes these means over during the start-spinning operation.

It has already been noted that the feed of the sliver during the start-spinning operation greatly influences the quality of the start-spinning point. In order to adapt the sliver feed to the speed present during the start-spinning operation, the suggestion has already been made (German Patent Application No. P 23 60 296.2) that the start-spinning operation be performed during the runup phase of the spinning rotor, which was previously stopped, and that the feed be simultaneously controlled in such a manner that the quantity of fibers fed is matched to the reduced start-spinning speed. However tests have shown that in spite of precise compliance with the conditions for reduced feed of the sliver the start-spinning points provided thereby still are of differing appearance and varying strength, with these differences occurring both in the case of repeated start-spinning on the same spinning unit and between different spinning units.

It is the object of the present invention to permit even more precise control of the sliver feed than previously, so that the quantity of fibers fed during the start-spinning operation can be matched to the start-spinning speed even more precisely than has previously been the case.

According to the present invention, this object is solved by a method for start-spinning a thread on open-end spinning units, in which an end of the thread is returned to a spinning rotor running in an under-pressure chamber, placed on a ring of fibers formed from individual fibers separated from a fed sliver and deposited in the spinning rotor, and then drawn off again, whereby in order to form a ring of fibers which is suitable for the start-spinning operation the feed of the sliver is switched on for a given period of time prior to the end of the thread being placed on the ring of fibers and the thread being drawn off again, the feed then being interrupted again and finally only switched on again for the actual start-spinning operation.

The present invention is based upon the realization that the sliver feed can only actually be precisely controlled if it can be assumed that the fiber tuft offered to the opener roller at the beginning of the sliver feed prior to the start-spinning operation is always the same. This was not always so in many cases. Tests have shown that the nature of the fiber tuft is greatly dependent upon the standstill period following which the sliver feed is started again. If a second start-spinning operation with controlled feed of the sliver is performed after a very brief standstill period, for example after an unsuccessful start-spinning attempt, the fiber tuft will be significantly thicker than would be the case after a long standstill period, after which the fiber tuft would have been heavily combed and become correspondingly thin. Consequently, in spite of precisely maintained uniform sliver-feed starting conditions, different quantities will be fed. According to the present invention, this possibility is eliminated in that prior to every start-spinning operation a precisely defined fiber tuft, which always recurs in the same shape, is produced by briefly switching on the sliver feed; the fiber tuft then permits precise control of the quantity of fibers fed.

The above discussed and other objects, features and advantages of the present invention will become more apparent from the following description of the practical examples and the subclaims, when taken in connection with FIGS. 1 to 8 of the accompanying drawings, in which FIG. 1 shows a graphic representation of the starting sequence of a spinning unit;

FIG. 5 shows an apparatus for performing the method according to the present invention, containing an auxiliary drive which handles the sliver feed prior to and for the start-spinning;

FIGS. 4 to 6 show details of embodiments according to the present invention for controlling the sliver feed.

Figure 1:
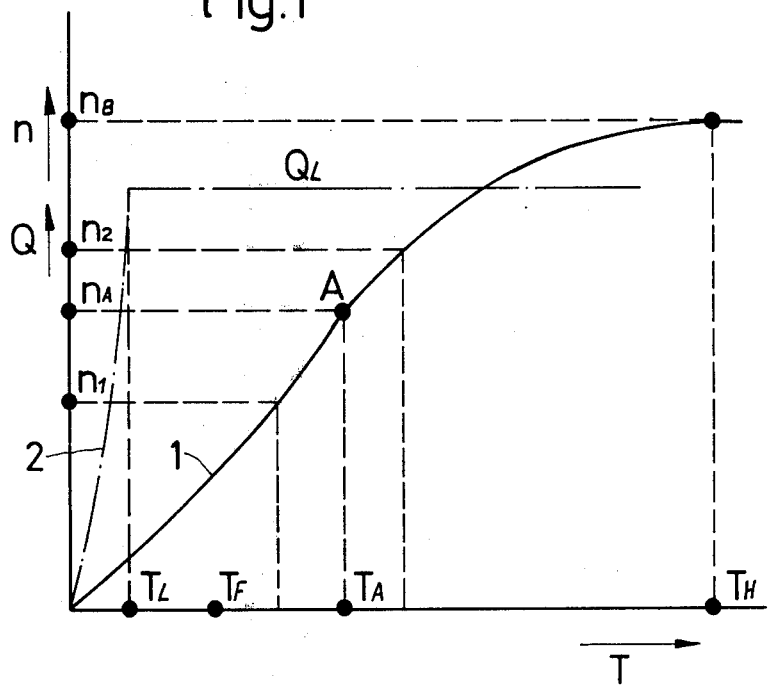

Referring now to the drawings, wherein like reference numerals designate like parts throughout the several views, FIG. 1 shows the speed $n$ of a spinning rotor during time T, in the form of a curve 1, during a starting sequence. The spinning rotor, starting from a standstill, reaches the operating speed $n_B$ at the moment $T_H$. It has been found that a favourable speed range, in which the start-spinning operation can be performed most reliably, is located between speeds $n_1$ and $n_2$, for example. Within this range, it is possible to stipulate a start-spinning point A on curve 1, which then also includes start-spinning time $T_A$ and start-spinning speed $n_A$, which is clearly slower than operating speed $n_B$.

To perform start-spinning at point A, the end of the thread must be returned prior to start-spinning time $T_A$, for example at time $T_F$, indicated on the abscissa, in order for the end of the thread to reach the ring of fibers deposited in the spinning rotor at time $T_A$, whereupon draw-off of the thread is initiated.

The dash-dotted curve 2 also contained in FIG. 1 represents the course of sliver feed Q through time T. As can be seen from this curve 2, after only a short time the sliver feed attains its maximum value $Q_L$ at time $T_L$. The period of time required therefor is considerably shorter than the period of time required for the starting sequence of the spinning rotor.

Curves 1 and 2 in FIG. 1 show clearly that at start-spinning time $T_A$ the sliver feed is greater than that required by operating conditions, which must result in a change in the quality of the yarn at the start-spinning point. For this reason, measures must be taken to ensure a suitable ratio between the fiber feed at start-spinning time $T_A$ and the reduced start-spinning speed $n_A$ of the spinning rotor. This is possible, for example, in that the fiber feed is initiated with a delay, so that time $T_L$, at which the operating feed quantity $Q_L$ is attained, is after start-spinning time $T_A$. Because of the steepness of curve 2, the switch-on and start-spinning must be performed at precisely stipulated moments, as the sliver feed conditions change very rapidly. In order to provide a longer period of time for the start-spinning operation, it is therefore advantageous to provide aids through which the steepness of curve 2 can be reduced, permitting operating feed $Q_L$ to be attained later.

Figure 2:
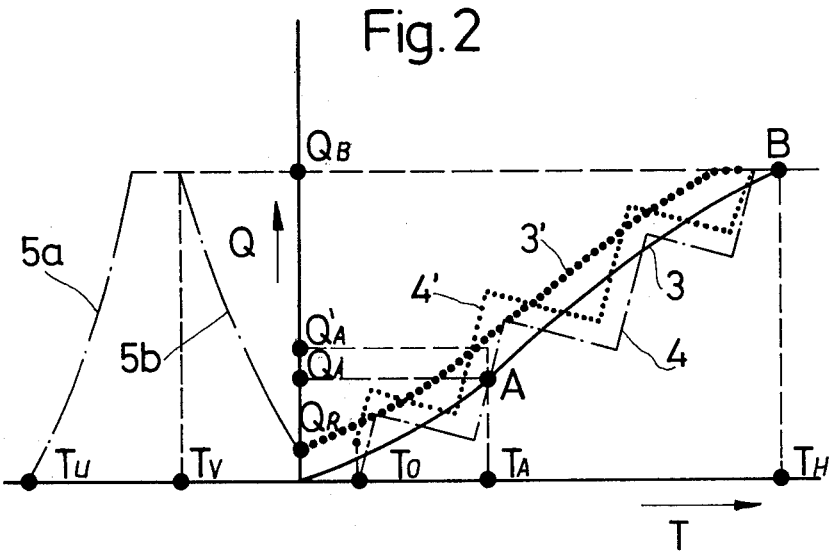
FIG. 2 shows a graphic representation of a reduced sliver feed during the starting sequence of the spinning unit with stipulation, according to the present invention, of the initial point for the feed.

It would be favourable for the start-spinning operation if curve 2 were influenced in such a manner that it had the same steepness as curve 1. A curve 3 of this type is illustrated in FIG. 2, which shows feed Q over time T. In many cases, it is sufficient for curve 3 to only be approximated, for example through a curve 4, shown as a dash-dotted line in FIG. 2, which often can be realized more simply from an engineering standpoint.

The above still assumes that the sliver feed begins at zero. However this does not coincide, or only seldom coincides, with the actual conditions. Since the opener roller, which follows the sliver feed means, continues to run without alteration after the sliver feed is switched off, the tuft offered to it continues to be combed so that a certain quantity of fibers still reaches the spinning rotor from the opener roller thereafter. This remainder is designated $Q_R$. If a controlled sliver feed according to curve 3 or 4 is now initiated for the start-spinning operation, these curves 3 and 4 do not begin at zero but at remainder $Q_R$, so that the course of the sliver feed is generally parallel to and at a clearly higher level than the illustrated curves, as suggested by the dotted lines 3' and 4'. It follows therefrom that at start-spinning time $T_A$ there is a start-spinning quantity $Q'_A$ which does not coincide with the theoretically calculated amount.

As already mentioned above, quantity $Q'_A$ depends upon how strongly the fiber tuft offered to the opener roller has been combed. How strongly the fiber tuft has been combed is a function of the period of time during which the opener roller still combs after the feed has been switched off. In this connection, combing occurs generally in accordance with an exponential function, which is illustrated in FIG. 2 as dash-dotted curve **5*b*. FIG. 2** thus shows quite clearly that the standstill period, i.e. the period between time $T_V$ of stopping and the commencement of the sliver feed, is of significant influence for the actual controlling operation. The shorter the stand-still period, the higher the fiber remainder $Q_R$.

In order to provide proper control of the quantity of fibers being fed, the present invention stipulates that before the actual start-spinning operation and the sliver feed occurring in the connection therewith, there is a sliver feed operation at time $T_u$, which is then switched off again at time $T_V$, thereby providing a precisely defined standstill period for the sliver feed, causing the same remainder $Q_R$ to be provided in all cases, so that precise control of the start-spinning quantity $Q'_A$ is then achieved on the basis of this remainder $Q_R$ and start-spinning quantity $Q'_A$ is the same in all cases. In this connection, it is practical for the sliver-feed switch-on time, which increases in accordance with dash-dotted curve **5*a***, to be maintained for a certain period of time, during which operating feed $Q_B$ is provided with certainty, as the influence of a remainder could otherwise still be disturbingly noticed with this brief sliver feed, the so-called preliminary feed. Since the spinning rotor is braked or stopped during the preliminary sliver feed operation, the fibers supplied to it are sucked away by means of an underpressure line, thereby preventing them from being deposited in the spinning rotor. The ring of fibers on which the return end of the thread is placed is thus formed only by the fibers supplied in the controlled sliver feed operation.

Figure 3:
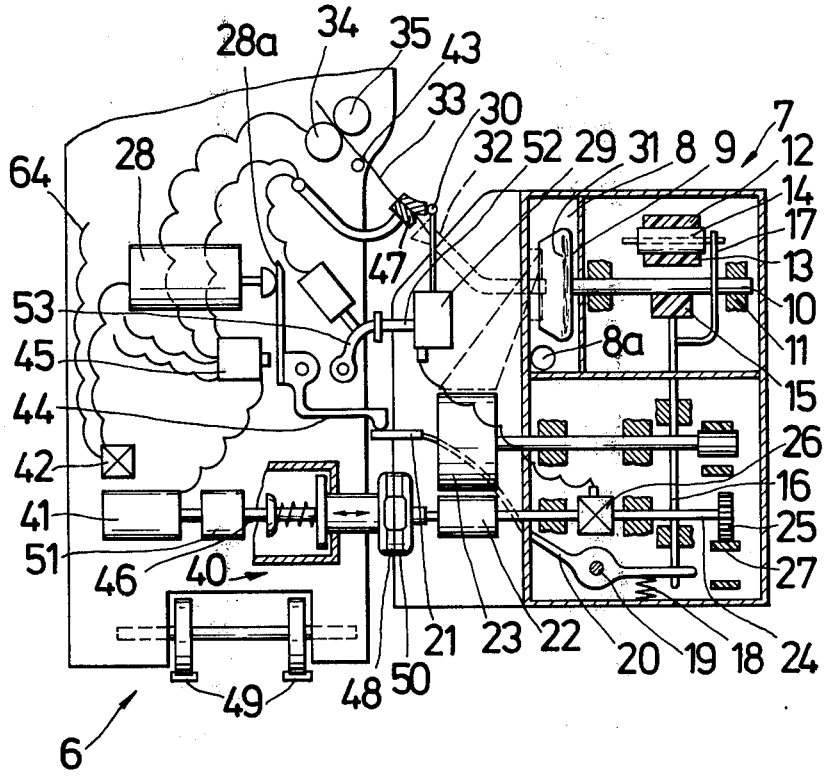

With the embodiment according to FIG. 3, both curve 3 and 3' as well as curve 4 and 4' in FIG. 2 can be realized when the sliver feed is started. In addition, preliminary feed according to curves **5*a* and 5*b* is also possible. Provided in the embodiment shown in FIG. 3 is a maintenance unit 6 which travels on rails 49 along an open-end spinning machine, of which only one spinning point 7 is illustrated schematically as a cross section. Rotating in an underpressure chamber 8, to which an underpressure line 8*a* is attached, is a spinning rotor 9, whose shaft 10 is mounted in bearings 11 in a housing located therebehind. Shaft 10 is driven by means of a tangential belt, whose bottom line 13 is pressed against the shaft by a pressure roller 14 in the operational condition, while the upper line 12 returns over pressure roller 14. In the illustrated brake condition, pressure roller 14 is lifted away from rotor shaft 10 together with the lower line 13 of the tangential belt, whereby rotor shaft 10 is braked by a brake 15. Brake 15 has an actuating rod 16, which is coupled with a lift-off mechanism 17 for pressure roller 14. Actuating rod 16 of brake 15 can be adjusted by means of a double lever 20, which is pivotally mounted about an axle 19. A tension spring 18 acts on double lever 20, said tension spring 18 pulling it into a position which releases rotor shaft 10. The free arm 21 of double lever 20 extends out of spinning unit 7** to the front.

Fibers are supplied to spinning rotor 9 in an opened state. To accomplish this, a sliver is caught by a supply roller 22 and advanced to an opener roller 23, from where the opened fibers reach spinning rotor 9. Supply roller 22 is connected to a toothed belt 27, extending in the longitudinal direction of the machine, by means of a shaft 24 and a gear 25. The connection between gear 25 and supply roller 22 can be interrupted by means of a solenoid clutch 26, which divides shaft 24. Clutch 26 is electrically connected with a switch 29 of a thread stop-motion 30, which switches off clutch 26 in the event of a thread break.

Maintenance unit 6 for start-spinning, which is only illustrated schematically, first receives the command to act upon a lever **28*a* by means of an actuating element illustrated in the form of a lifting magnet 28; this command is received from a control element 42, which is triggered by means of an electrical lead 64 after maintenance unit 6 is positioned at the respective spinning point 7. The above sequence causes a lever 44 connected therewith to be pressed against the free arm 21 of double lever 20 of spinning unit 7, thereby braking spinning rotor 9. And finally, control element 42 causes an auxiliary drive of maintenance unit 6 to be temporarily coupled with the sliver feed drive of spinning unit 7. In the illustrated embodiment, the auxiliary drive of maintenance unit 6 contains an electric variable-speed motor 41, whose runup is adjustable. A wound-rotor motor with appropriate rheostatic starting circuitry or a variable-speed d.c. motor with smooth starting can be provided for this purpose. Variable-speed motor 41 drives a shaft 46, which is connected with a driving wheel 48. Shaft 46 and driving wheel 48 are connected via adjusting means 40, which permit driving wheel 48 to be shifted axially. Arranged opposite driving wheel 48 is a counterwheel 50, which is rigidly connected with supply roller 22 and which is accessible from the outside. A gear or friction clutch can be arranged between driving wheel 48 and counterwheel 50. The sliver feed is then switched on for a brief preselected period of time by means of the auxiliary drive of maintenance unit 6. This set period of time is selected in such a manner as to permit the fiber tuft to attain a uniform condition. When the feed is then switched off again opener roller 23**, which continues to run, can continue to comb the fiber tuft. The actual start-spinning operation then commences after a second precisely defined and preselected period of time.

Maintenance unit 6 picks up a thread end 33 from an unillustrated winding cone and returns it to spinning rotor 9 through a yarn removal channel 32, whereby it is placed on a fiber ring 31 in spinning rotor 9. Thread end 33 is returned by means of auxiliary draw-off rollers 34 and 35 of maintenance unit 6, of which at least roller 34 can be driven in either sense of rotation. Thread end 33 is sucked into spinning rotor 9 by means of the suction in underpressure chamber 8. The reversal of the sense of rotation of auxiliary draw-off roller 34 is controlled by means of a thread tension feeler 43 of maintenance unit 6.

In order to be able to start spinning at a rotor speed which is lower than the operating speed, the start-spinning operation is performed during the starting sequence of spinning rotor 9. This is accomplished by means of starting lever 44 which, as described above, rests on free arm 21 of double lever 20 of brake 15. When free arm 21 of brake 15 is released, which is the case when lifting magnet 28 retracts, starting lever 44 is actuated and, in turn, actuates a starting switch 45, which has a time-lag relay. Starting switch 45 is connected with a drive motor of auxiliary draw-off rollers 34 and 35 for performing the start-spinning operation, on the one hand, and with the auxiliary drive, on the other, through which supply roller 22 is driven in such a manner that its starting characteristic, and thus feed of the sliver, corresponds at least approximately to the starting characteristic of spinning rotor 9. The main drive of the sliver feed must remain off during this period of time, with solenoid clutch 26 remaining open. This can be controlled by means of an electrical timing element, for example, which only closes clutch 26 after a delay, even if thread stop-motion 30 has been placed in its operating position again which, in the illustrated embodiment, is performed by means of a thread trapper 47 of maintenance unit 6, which offers the thread end 33 to the opening of yarn removal channel 32. In the illustrated embodiment, it can be ensured, with the aid of additional switching means of maintenance unit 6, that clutch 26 remains open, so that here, also, the sophistication of the individual spinning units 7 remains small. For this purpose, switch 29 of thread stop-motion 30 is designed as a double switch, which can also be switched by a pusher 52 in such a manner that clutch 26 remains open. The pusher is reversed by means of a lever 53 of maintenance unit 6 associated to it, said lever 53 being switched with the aid of an electric servo element. This servo element, and thus lever 53, can be coupled electrically with thread trapper 47, so that swivelling thread stop-motion 30 into its operating position with the aid of thread trapper 47 results in actuation of pusher 52, so that clutch 26 remains open. After the start-spinning operation, clutch 26 is closed, thereby starting the main drive of the sliver feed. In order to avoid mutual damage to the auxiliary drive and the main drive, freewheeling means 51 are installed in the auxiliary drive. This also ensures that the transition of the sliver feed from the auxiliary drive to the main drive is uniform and smooth.

It is also possible to actuate the servo element of lever 53 with a timing programme in such a manner as to switch the main drive of supply roller 22 on and off intermittently, which results in a starting-sequence characteristic according to curves 4 and 4', as well as curves **5*a* and 5*b* in FIG. 2**. This permits the runup characteristic of the sliver feed to be adapted to the starting characteristic of the spinning rotor in the desired manner, without the employment of an auxiliary drive.

Shown in FIG. 4 is an embodiment in which supply roller 22 of spinning unit 7 is driven by means of a shaft, extending through the machine longitudinally, via gears 56, 55 and 54, by means of a standing shaft drive. The standing shaft is divided between gears 55 and 54, designed as helical gears, by means of a solenoid clutch 26. This solenoid clutch 26 is switched by a switch 29 of a thread stop-motion 30 in a similar manner to that in the embodiment according to FIG. 3. The standing shaft extends beyond gear 54, and its free end is connected with a driver wheel 57, whose periphery protrudes beyond the cover of spinning unit 7. Associated to this driver wheel 57 is a driving wheel 58, which belongs to an auxiliary drive, containing freewheeling means, of mobile maintenance unit 6. In this embodiment, also, the desired starting characteristic of the sliver feed can be realized by means of an auxiliary drive controlled by maintenance unit 6. It is ensured, in a manner corresponding to that of FIG. 3, that clutch 26 remains open during the start-spinning operation. Driving wheel 58 is connected with a variable-speed motor 60, and can be pivoted about an axle 61 of maintenance unit 6 together with variable-speed motor 60 and its shaft 59.

FIGS. 5 and 6 show apparatuses with which it is possible to attain a starting characteristic according to curve 4 or 4' in FIG. 2. Controlled by control element 42, in FIG. 5 an actuating member 62, designed as a lifting magnet, can alternately switch thread stop-motion switch 29 on and off by means of a piston 63, causing the thread stop-motion to alternately assume positions 30 and **30*a*. The feed drive is coupled to switch 29 in the above-described manner, thereby producing intermittent feed. In FIG. 6, a trappper 69, controlled by the thread stop-motion, is pressed against the sliver and trough 67 in the event of a thread break, thereby stopping the feed. The lifting magnet 66 which actuates trapper 69 is acted upon by a further lifting magnet 65 of maintenance unit 6. Lifting magnet 65, controlled by control element 42, presses lever 72, and thus trapper 69, alternately against trough 67 and away from it against the force of lifting magnet 66**, which is maintained, thereby alternately switching the feed on and off.

Figure 7:
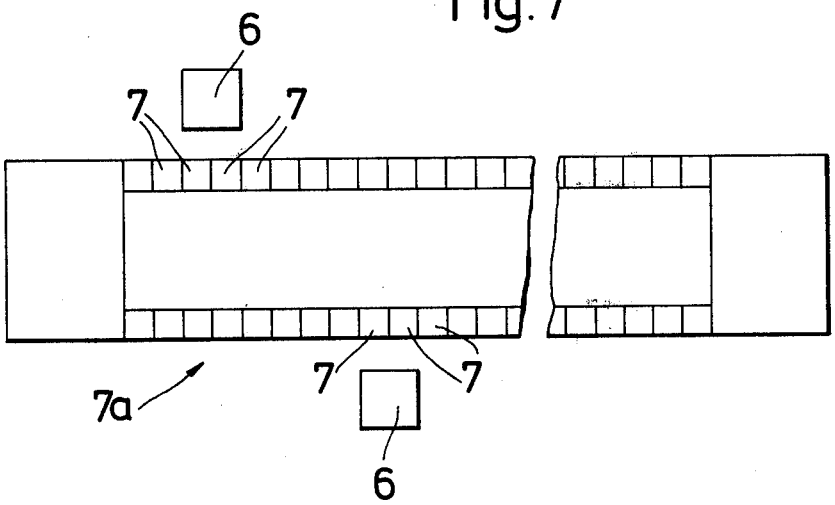
FIGS. 7 and 8 show top views of open-end spinning machines equipped with maintenance units according to the present invention.
Figure 8:
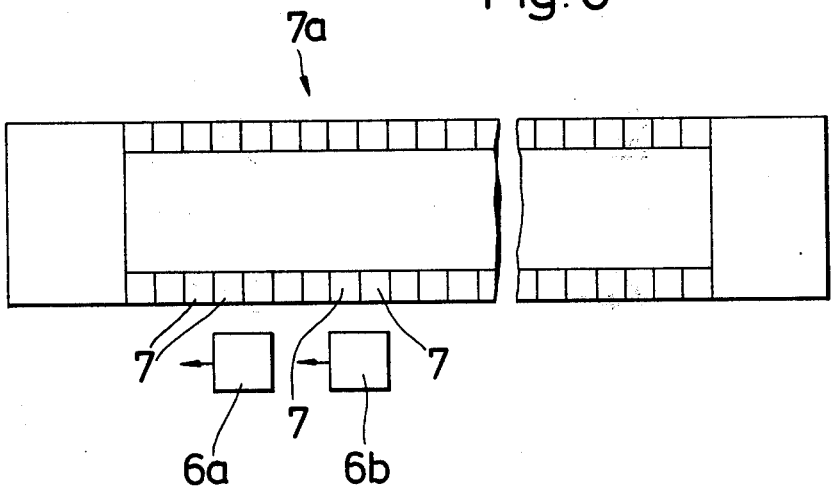

FIGS. 7 and 8 schematically illustrate the difference between two different solutions for the design of maintenance units 6. The open-end spinning machine 7*a* in FIG. 7 has two rows of spinning units 7. Travelling on each side of the machine is a maintenance unit 6 designed as a start-spinning unit, which performs the entire start-spinning operation. Alternatively, of course, it would also be possible for one single start-spinning unit to handle both sides of the machine or a plurality of machines 7*a*. In the embodiment according to FIG. 8, the start-spinning unit is divided into two partial units 6*a* and 6*b*, which service a spinning point 7 requiring maintenance one after the other, after preselected periods of time. Partial units 6*a* and 6*b* work at different spinning points 7 simultaneously. Partial unit 6*a* can handle the above-described preliminary feed operation, for example, while partial unit 6*b* can later perform the actual start-spinning operation after a precisely stipulated period of time.

Obviously, many modifications and variations of the present invention are possible in the light of the above teachings. It should therefore be understood that within the scope of the appended claims, the invention may be practiced otherwise than as specifically described.

Having thus fully disclosed our invention, what we claim is:

1. A method for start-spinning a thread on open-end spinning units, in which an end of the thread is returned to a spinning rotor running in an under-pressure chamber, placed on a ring of fibers formed from individual fibers separated from a fed sliver and deposited in said spinning rotor, and then drawn off again, whereby in order to form a ring of fibers which is suitable for the start-spinning operation the feed of said sliver is switched on for a given period of time prior to said end of said thread being placed on said ring of fibers and the thread being drawn off again, the feed then being interrupted again and finally only switched on again for the actual start-spinning operation.

2. The method according to claim 1, in which the end of the thread is placed on the ring of fibers while the spinning rotor runs up from its stopped condition to its operating speed and in which the sliver feed is reduced during this sequence.

3. An apparatus for start-spinning a thread on open-end spinning units, in which each spinning unit is equipped with means for feeding a sliver which are switched off after a thread break, said means being acted upon by control means of a travelling maintenance unit, which is equipped with means which switch means for feeding said sliver of said spinning unit on and/or off, in which the maintenance unit is divided into two independently travelling partial units, one containing the means for switching the sliver feed on and off for a given period of time and the other containing means for performing the actual start-spinning operation.

4. An apparatus for start-spinning a thread on open-end spinning units, in which each spinning unit is equipped with means for feeding a sliver which are switched off after a thread break, said means being acted upon by control means of a travelling maintenance unit, which is equipped with means for feeding said sliver of said spinning unit on and/or off, in which the maintenance unit is equipped with drive means which can be coupled with appropriately designed means for feeding the sliver of the respective spinning unit, whose drive contains means for stopping it during the start-spinning operation.

5. The apparatus according to claim 4, in which the maintenance unit contains a driving wheel which can be shifted so as to come in contact with a counterwheel of the spinning unit, said counterwheel being connected with a supply roller.

6. A method for thread piecing in an open-end spinning unit, starting with an operating spinning unit, comprising the sequential steps of:

stopping a sliver feeding means, which sliver feeding means is arranged for supplying sliver to an opening device, stopping a spinning rotor of said spinning unit, starting the sliver feeding means to supply sliver to said opening device, stopping said sliver feeding means, starting the spinning rotor of the spinning unit, again starting said sliver feeding means to supply sliver to said spinning rotor via said opening device to form a fiber ring in said spinning rotor, introducing a thread end into the spinning rotor and piecing of same with said fiber ring, and drawing off of the thread from the spinning rotor.

7. A method according to claim 6, further comprising supplying a vacuum to said spinning rotor prior to starting said spinning rotor, whereby fiber supplied to said spinning rotor by said sliver feeding means and said opening device is removed to accommodate subsequent uniform piecing operations upon again starting said sliver feeding means.

8. A method according to claim 6, wherein said introducing a thread end into the spinning rotor and said piecing is done during acceleration of said spinning rotor toward its operating spinning speed and before said spinning rotor reaches its operating spinning speed.

9. A method according to claim 8, wherein said piecing is conducted while operating said sliver feeding means at a level below the operational spinning speed of said sliver feeding means.

10. A method according to claim 9, further comprising supplying a vacuum to said spinning rotor prior to starting said spinning rotor, whereby fiber supplied to said spinning rotor by said sliver feeding means and said opening device is removed to accommodate subsequent uniform piecing operations upon again starting said sliver feeding means.

11. A method for thread piecing an open-end spinning unit, starting with a stopped spinning unit, comprising the sequential steps of:

starting a yarn opening device of said spinning unit, starting sliver feeding means of said spinning unit to supply sliver to said opening device, stopping said sliver feeding means, starting a spinning rotor of the spinning unit, again starting said sliver feeding means to supply sliver to said spinning rotor via said opening device to form a fiber ring in said spinning rotor, introducing a thread end into the spinning rotor and piecing of same with said fiber ring, and drawing off of the thread from the spinning rotor.

12. A method according to claim 11, further comprising supplying a vacuum to said spinning rotor prior to starting said spinning rotor, whereby fiber supplied to said spinning rotor by said sliver feeding means and said opening device is removed to accommodate subsequent uniform piecing operations upon again starting said sliver feeding means.

13. A method acording to claim 11, wherein said introducing a thread end into the spinning rotor and said piecing is done during acceleration of said spinning rotor toward its operating spinning speed and before said spinning rotor reaches its operating spinning speed.

14. A method according to claim 13, wherein said piecing is conducted while operating said sliver feeding means at a level below the operational spinning speed of said sliver feeding means.

15. A method according to claim 14, further comprising supplying a vacuum to said spinning rotor prior to starting said spinning rotor, whereby fiber supplied to said spinning rotor by said sliver feeding means and said opening device is removed to accommodate subsequent uniform piecing operations upon again starting said sliver feeding means.

16. In a method for thread piecing in an open-end spinning unit of the type wherein thread piecing is carried out during acceleration of an initially stopped spinning rotor towards its operating spinning speed, the improvement comprising the following preparatory steps before starting the spinning rotor to perform the piecing operation:

operating sliver feeding means to supply sliver to an operating opening device arranged upstream of said spinning rotor, and stopping said sliver feeding means while permitting said opening device to continuously operate and comb out fiber held by said sliver feeding means, whereby uniform fiber tufts are arranged at said sliver feeding means to accommodate said piecing operation to be subsequently performed.

17. Apparatus for thread piecing in an open-end spinning assembly comprising:

opening means for opening sliver being supplied to a spinning rotor of said spinning assembly, feeding means for feeding sliver to said fiber opening means, piecing means including means for introducing a thread end back into said spinning rotor to be pieced together with a fiber ring formed in said spinning rotor, rotor control means for moving said spinning rotor from a stop condition toward an operating spinning speed to accommodate piecing by said piecing means, and fiber supply preparing means for preparing said spinning assembly for a piecing operation prior to movement of said spinning rotor from its stopped position, said fiber supply preparing means including means for starting and operating said feeding means for a period of time and then stopping said feeding means, said starting and stopping being accompanied by a continuously operating opening means, whereby uniform fiber tufts are arranged at said sliver feeding means to accommodate said piecing operation to be subsequently performed.

18. Apparatus according to claim 17, further comprising means for supplying a vacuum to said spinning rotor to remove any fiber supplied during said preparation of said spinning assembly by said preparing means.

19. Apparatus according to claim 18, wherein said piecing means includes means for controlling introduction of said thread end into the spinning rotor and said piecing so as to take place during acceleration of said spinning rotor toward its operating spinning speed and before said spinning rotor reaches it operating spinning speed.

20. Apparatus according to claim 19, further comprising apparatus for controlling said sliver feeding means to operate at a level below the operational spinning speed of said sliver feeding means during said piecing.

21. Apparatus according to claim 17, in which each spinning unit of the spinning assembly is equipped with sliver feeding means, and wherein a travelling maintenance is provided which is equipped with means for controlling the sliver feeding means during said preparation and during initial phases of said piecing operation.

22. Apparatus according to claim 17, in which each spinning unit of said spinning assembly is equipped with sliver feeding means, and wherein a travelling maintenance unit is provided which is equipped with means for switching said sliver feeding means on and off.

23. In apparatus for thread piecing in an open-end spinning unit of the type wherein thread piecing is carried out during acceleration of an initially stopped spinning rotor toward its operating spinning speed, the improvement comprising preparatory means for performing the following preparatory steps before starting the spinning rotor to perform the piecing operation:

operating sliver feeding means to supply sliver to an operating opening device arranged upstream of said spinning rotor, and stopping said sliver feeding means while permitting said opening device to continuously operate and comb out fiber held by said sliver feeding means, whereby uniform fiber tufts are arranged at said sliver feeding means to accommodate said piecing operation to be subsequently performed.

24. Apparatus according to claim 23, in which each spinning unit of the spinning assembly is equipped with sliver feeding means, and wherein a travelling maintenance unit is provided which is equipped with means for controlling the sliver feeding means during said preparation and during initial phases of said piecing operation.

25. Apparatus according to claim 23, in which each spinning unit of said spinning assembly is equipped with sliver feeding means, and wherein a travelling maintenance unit is provided which is equipped with means for switchng said sliver feeding means on and off.

26. The apparatus according to claim 25, in which each spinning unit is equipped with trapping means for said sliver which can be actuated to shut off the sliver feed, said trapping means being capable of being switched on and off from the outside by a switching element of the maintenance unit.

27. The apparatus according to claim 25, in which each spinning unit is equipped with a thread stop-motion and a thread stop-motion switch, which controls a clutch arranged in the sliver feed drive and which can also be adjusted from the outside by means of a switching element of the maintenance unit.

* * * * *